US012196076B1

(12) United States Patent
Zeng et al.

(10) Patent No.: US 12,196,076 B1
(45) Date of Patent: Jan. 14, 2025

(54) GROUTING AND WATER BLOCKING METHOD FOR DIRECTIONAL HOLE WITH LARGE OFFSET IN HARD ROCK STRATUM

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Qiang Wu, Beijing (CN); Xinjiang Wei, Beijing (CN); Xuejun Wang, Beijing (CN); Kai Pang, Beijing (CN); Xuan Xiao, Beijing (CN); Xue Liu, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/750,211

(22) Filed: Jun. 21, 2024

(30) Foreign Application Priority Data

Sep. 14, 2023 (CN) ..... 202311188205.2

(51) Int. Cl.
*E21B 49/00* (2006.01)
*E21B 7/04* (2006.01)
(Continued)

(52) U.S. Cl.
CPC ..... *E21B 49/005* (2013.01); *E21B 7/04* (2013.01); *E21B 21/062* (2013.01); *E21B 33/138* (2013.01)

(58) Field of Classification Search
CPC ..... E21B 49/005; E21B 7/04
See application file for complete search history.

(56) References Cited

U.S. PATENT DOCUMENTS 11,203,922 B1 * 12/2021 Sun ..... E21B 34/04
2009/0260824 A1 * 10/2009 Burns ..... E21B 36/04 166/57
(Continued)

FOREIGN PATENT DOCUMENTS

CA 2975614 A1 12/2017
CN 106014419 A 10/2016
(Continued)

OTHER PUBLICATIONS

First Office Action issued in counterpart Chinese Patent Application No. 202311188205.2, dated May 9, 2024.
(Continued)

*Primary Examiner* — Ricky Go
(74) *Attorney, Agent, or Firm* — Westbridge IP LLC

(57) ABSTRACT

Disclosed is a grouting and water blocking method for a hard rock stratum. The grouting and water blocking method include the following steps. At first, hydrogeological information and coal seam information of a hard rock stratum is obtained. Then, a drilling trajectory of the hard rock stratum is determined based on the hydrogeological information and the coal seam information. Later, at least one drilling device is determined corresponding to the drilling trajectory based on types of multiple rock layers contained in the hard rock stratum. After that, the multiple rock layers contained in the hard rock stratum are drilled sequentially according to the drilling trajectory using the at least one drilling device. At last, in response to determining there is a water leakage area, the water leakage area is grouted.

8 Claims, 2 Drawing Sheets

(51) Int. Cl.
*E21B 21/06* (2006.01)
*E21B 33/138* (2006.01)

(56) References Cited

U.S. PATENT DOCUMENTS

| | | | | |
|---|---|---|---|---|
| 2022/0106879 | A1* | 4/2022 | Hou | E21D 11/18 |
| 2022/0290563 | A1* | 9/2022 | Li | E21B 49/00 |
| 2023/0075452 | A1 | 3/2023 | Wang et al. | |

FOREIGN PATENT DOCUMENTS

| | | | |
|---|---|---|---|
| CN | 107044289 | A | 8/2017 |
| CN | 110017155 | A | 7/2019 |
| CN | 110761814 | A | 2/2020 |
| CN | 112377221 | A | 2/2021 |
| DE | 4340253 | A1 | 6/1995 |
| EA | 201500013 | A1 | 7/2016 |

OTHER PUBLICATIONS

Yao, Application of Ground Directional Bedding Drilling in Grouting Reconstruction of Aquifer in Mining Face, Modernization of Coal Mines, 2020 (4), pp. 185-190, dated Jun. 29, 2020.

* cited by examiner

GROUTING AND WATER BLOCKING METHOD FOR DIRECTIONAL HOLE WITH LARGE OFFSET IN HARD ROCK STRATUM

CROSS-REFERENCE TO RELATED APPLICATIONS

This application claims priority to Chinese Patent Application No. 202311188205.2, filed on Sep. 14, 2023, the content of which is incorporated herein by reference in its entirety.

TECHNICAL FIELD

The present application relates to coal mining technology, in particular to a grouting and water blocking method for a directional hole with a large offset in a hard rock stratum.

BACKGROUND

With continuous changes in human's life, demands for coal resources are increasing day by day. A coal mine is an important passage for extracting coal resources. However, a roof of a coal seam is usually covered with a thick sandstone aquifer, which makes water filling intensity of the coal seam is high. Therefore, it is very important to avoid water inrush in the coal mine. Conventionally, grouting or drainage methods are taken to prevent a water inrush from the roof of the coal seam into the coal mine.

However, a high-intensity coal resource extraction may lead to a complete fracture of overlying rock layers, which may cause groundwater to flow into the coal mine resulting in a sharp increase in mine water inflow. At present, there is relatively little research on grouting and water blocking in a hard rock stratum. Therefore, no specific solutions for grouting and water blocking for a hard rock stratum have been provided.

SUMMARY

In view of the above, examples of the present disclosure provide a grouting and water blocking method for a hard rock stratum.

The grouting and water blocking method for a hard rock stratum according to examples of the present disclosure may include: obtaining hydrogeological information and coal seam information of a hard rock stratum; determining a drilling trajectory of the hard rock stratum based on the hydrogeological information and the coal seam information; determining at least one drilling device corresponding to the drilling trajectory based on types of multiple rock layers contained in the hard rock stratum; drilling the multiple rock layers contained in the hard rock stratum sequentially according to the drilling trajectory using the at least one drilling device; in response to determining there is a water leakage area in one of the multiple rock layers after drilling, grouting into the water leakage area.

In some examples of the present disclosure, determining a drilling trajectory of the hard rock stratum based on the hydrogeological information and the coal seam information may include: determining a drilling range of the hard rock stratum based on the hydrogeological information and the coal scam information; selecting a drilling start point that meets a preset condition within the drilling range; and determining the drilling trajectory corresponding to the drilling start point.

In some examples of the present disclosure, the drilling range of the hard rock stratum may be determined according to formula $L \geq L_1 + \Sigma_{i=1} \Delta Sec\theta_i l_i + \Sigma_{j=1} \Delta Sec\theta_0 l_j + L_2$, where, L represents a drilling radius, $L_1$ represents a length of a first straight section corresponding to the drilling start point, $L_2$ represents a length of a second straight section corresponding to a drilling end point, $\theta_i$ represents a drilling inclination angle of an increasing inclined section between the drilling start point and the drilling end point, $\theta_0$ represents a drilling inclination angle of a stable inclined section between the drilling start point and the drilling end point, $\Delta l_i$ represents a spacing between every two measurement points during a drilling process of the increasing inclined section, and $\Delta l_j$ represents a spacing between every two measurement points during a drilling process of the stable inclined section. To be noted, the drilling end point may be a preset point in a preset grouting area for water blocking. Moreover, in the above formular for determining the drilling range, $\Delta Sec\theta_i l_i$ may represent a length of a projection of the increasing inclined section on a vertical projection plane and $\Delta Sec\theta_0 l_j$ may represent a length of a projection of the stable inclined section on the vertical projection plane. In examples of the present disclosure, for sake of clarity, the above formula for determining the drilling range can also be represented as $L \geq L_1 + \Sigma_{i=1} Sec\theta_i \Delta l_i + \Sigma_{j=1} Sec\theta_0 \Delta l_j + L_2$. That is, $\Delta Sec\theta_i l_i = Sec\theta_i \Delta l_i$ and $\Delta Sec\theta_0 l_j = Sec\theta_0 \Delta l_j$.

In some examples of the present disclosure, determining at least one drilling device corresponding to the drilling trajectory based on types of multiple rock layers contained in the hard rock stratum may include: for each rock layer of the multiple rock layers, determining a hardness of the rock layer, and determining a drilling device for the rock layer based on the hardness of the rock layer; where, rock layers with different hardness may correspond to different drilling devices.

In some examples of the present disclosure, whether there is a water leakage area in one of the multiple rock layers may be determined by determining whether a volume of drilling fluid recycled by the drilling device is less than a preset volume of the drilling fluid; and in response to determining the volume of drilling fluid recycled by the drilling device is less than the preset volume of the drilling fluid, a water leakage area occurs.

In some examples of the present disclosure, the multiple rock layers may include: a layered coal seam, a Carboniferous coal seam, or a Jurassic coal scam.

In some examples of the present disclosure, the method may further include: if a rock layer corresponding to the water leakage area is a layered coal seam, the water leakage area is determined by the following formula:

$$H_{f1} = \frac{100\sum M_1}{1.6\sum M_1 + 3.6} \pm 5.6;$$

where, $H_{f1}$ represents the water leakage area corresponding to the layered coal seam; and $M_1$ represents a mining thickness of the layered coal seam; if a rock layer corresponding to the water leakage area is a Carboniferous coal seam, the water leakage area is determined by the following formula:

$$H_{f2} = \frac{100\sum M_2}{0.26\sum M_2 + 6.88} \pm 5.6;$$

where, $H_{f2}$ represents the water leakage area corresponding to the Carboniferous coal seam, and $M_2$ represents a mining thickness of the Carboniferous coal seam; if a rock layer corresponding to the water leakage area is a Jurassic coal seam, the water leakage area is determined by the following formula: $H_{f3}=20M_3\pm10$, where, $H_{f3}$ represents the water leakage area corresponding to the Jurassic coal seam, and $M_3$ represents a mining thickness of the Jurassic coal scam.

In some examples of the present disclosure, the method may further include: before grouting into the water leakage area, in response to determining that a leakage amount in the water leakage area is less than a first preset leakage amount and greater than or equal to a second preset leakage amount, adjusting a ratio of liquid to a first solid in a slurry to be injected in the drilling device based on the leakage amount; and in response to determining that the leakage amount in the water leakage area is greater than or equal to the first preset leakage amount, a second solid is added to the slurry to be injected in the drilling device, and adjusting a ratio of the liquid, the first solid, and the second solid in the slurry to be injected in the drilling device based on the leakage amount.

In some examples of the present disclosure, the hydrogeological information may include rock hardness corresponding to each rock layer. The method may further include: before drilling the multiple rock layers contained in the hard rock stratum sequentially according to the drilling trajectory using the at least one drilling device, for each rock layer, detecting a detected hardness of the rock layer; in response to determining that a difference between the detected hardness of the rock layer and the rock harness corresponding to the rock layer is greater than a preset difference, adjusting the drilling device corresponding to the rock layer.

In some examples of the present disclosure, the method may further include: after grouting into the water leakage area, monitor the water leakage area after grouting; and replacing the slurry in response to determining the slurry fails to block water.

In some examples of the present disclosure, the method may further include: after grouting into the water leakage area, determining a weight of rock debris recycled by the drilling device; and in response to determining that the weight is less than or equal to a preset weight, increasing a viscosity of the drilling fluid.

It can be seen that in the grouting and water blocking method for a hard rock stratum provided by this disclosure, the drilling trajectory of the hard rock stratum can be determined based on the hydrogeological information and the coal seam information of the hard rock stratum obtained. The step of determining the drilling trajectory lays a foundation for a smooth progress of drilling. Further, based on the types of multiple rock layers contained in the hard rock stratum, at least one drilling device corresponding to the drilling trajectory can be determined to ensure an efficient drilling. Then, using the at least one drilling device, the multiple rock layers in the hard rock stratum may be drilled sequentially according to the drilling trajectory, which ensures the smooth progress of drilling. At last, whether there is a water leakage area in the rock layers are determined after drilling. If there is a water leakage area, the water leakage area may be grouted to achieve a purpose of sealing the water leakage area, which may greatly reduce a permeability coefficient of the aquifer. In this way, a lateral water inflow of the aquifer may be greatly reduced, and water damages and rock burst disasters can be prevented and controlled. As a result, a safety production of a coal mine can be achieved.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
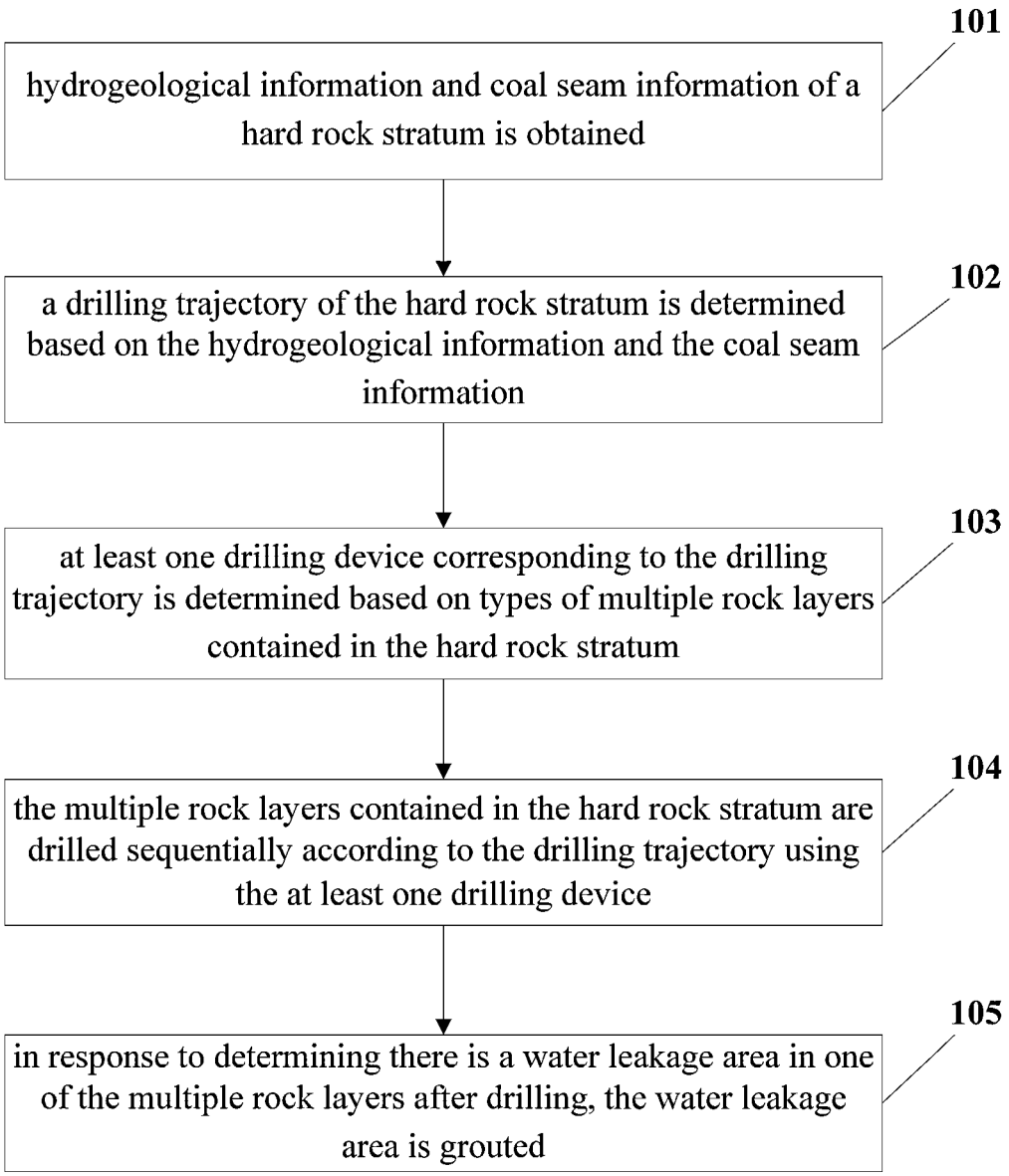
FIG. 1 is a schematic flowchart of the grouting and water blocking method for a hard rock stratum according to an example of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As disclosed above, with continuous changes in human's life, demands for coal resources are increasing day by day. A coal mine is an important passage for extracting coal resources. The coal mine may perform various transportations for coal mine production by connecting a mining workface with other facilities. In addition, the coal mine also undertakes various important functions such as ventilation, drainage, electricity supply and oxygen supply. However, a roof of a coal seam is usually covered with a thick sandstone aquifer, which makes the water filling intensity of the coal seam is high. Therefore, it is very important to avoid water inrush in the coal mine. Conventionally, grouting or advanced drainage methods are taken to prevent a water inrush from the roof of the coal seam into the coal mine.

In conventional grouting or advanced drainage method, a distribution pattern of lithology may be determined through inversion based on the lithology and water abundance of an overlying stratum over the coal seam. At the same time, a fracture development space in the mining area may be predicted according to a development height of a water conducting fracture zone in the stratum. Before coal resource extractions, grouting may be carried out to create a waterproof curtain, in order to reduce a risk of water inrush from an overlying thick sandstone aquifer in the coal scam.

However, a high-intensity coal resource extraction may lead to a complete fracture of overlying rock layers, which may cause groundwater to flow into the coal mine resulting in a sharp increase in mine water inflow. At present, there is relatively little research on grouting and water blocking in a hard rock stratum. Therefore, no specific solutions for grouting and water blocking for a hard rock stratum have been provided.

To solve the above problems, examples of the present disclosure provide a grouting and water blocking method for a hard rock stratum. FIG. 1 is a schematic flowchart of the grouting and water blocking method for a hard rock stratum according to an example of the present disclosure. As shown in FIG. 1, the grouting and water blocking method may include the following steps.

In step 101, hydrogeological information and coal seam information of a hard rock stratum is obtained.

In example of the present disclosure, the hard rock stratum is composed of rocks with solid particle connections and high mechanical strength. As a result, a construction of a mine may be very difficult. In this case, it is necessary to determine a grouting and water blocking scheme under hard rock geological conditions before the construction of the mine. Firstly, before grouting and water blocking in the hard rock stratum, it is necessary to obtain the hydrogeological information and the coal seam information of the hard rock stratum to lay a foundation for determining the grouting and water blocking method for hard rock stratum. By conducting a comprehensive analysis of survey results of the hard rock stratum, combined with coal scam geological data and underground mining data related to the hard rock stratum, the hydrogeological information and the coal seam information can be determined. Among them, the underground mining data may include: historical drilling results, geophysical logging data, sampling and pumping experimental data, groundwater dynamic observation data, location and thickness of aquifers and water conducting fracture zones, distribution of chemical elements in mine water, as well as distance and thickness between an aquifer roof and a coal seam roof.

In step 102, a drilling trajectory of the hard rock stratum is determined based on the hydrogeological information and the coal seam information.

In example of the present disclosure, when mining coal resources in a hard rock stratum, if a vertical path between a drilling end point in the coal seam and a drilling start point on the ground is used as the drilling trajectory, a high-intensity extraction of coal resources may induce a complete fracture on the overlying rock layer, which may affect the entire drilling trajectory and increase the water inflow in the mine greatly. In order to solve the above problems, the drilling trajectory in the present disclosure may be determined through a comprehensive analysis of the hydrogeological information such as lithology, porosity, and water content of each layer of the hard rock strata, as well as the coal seam information.

Figure 2:
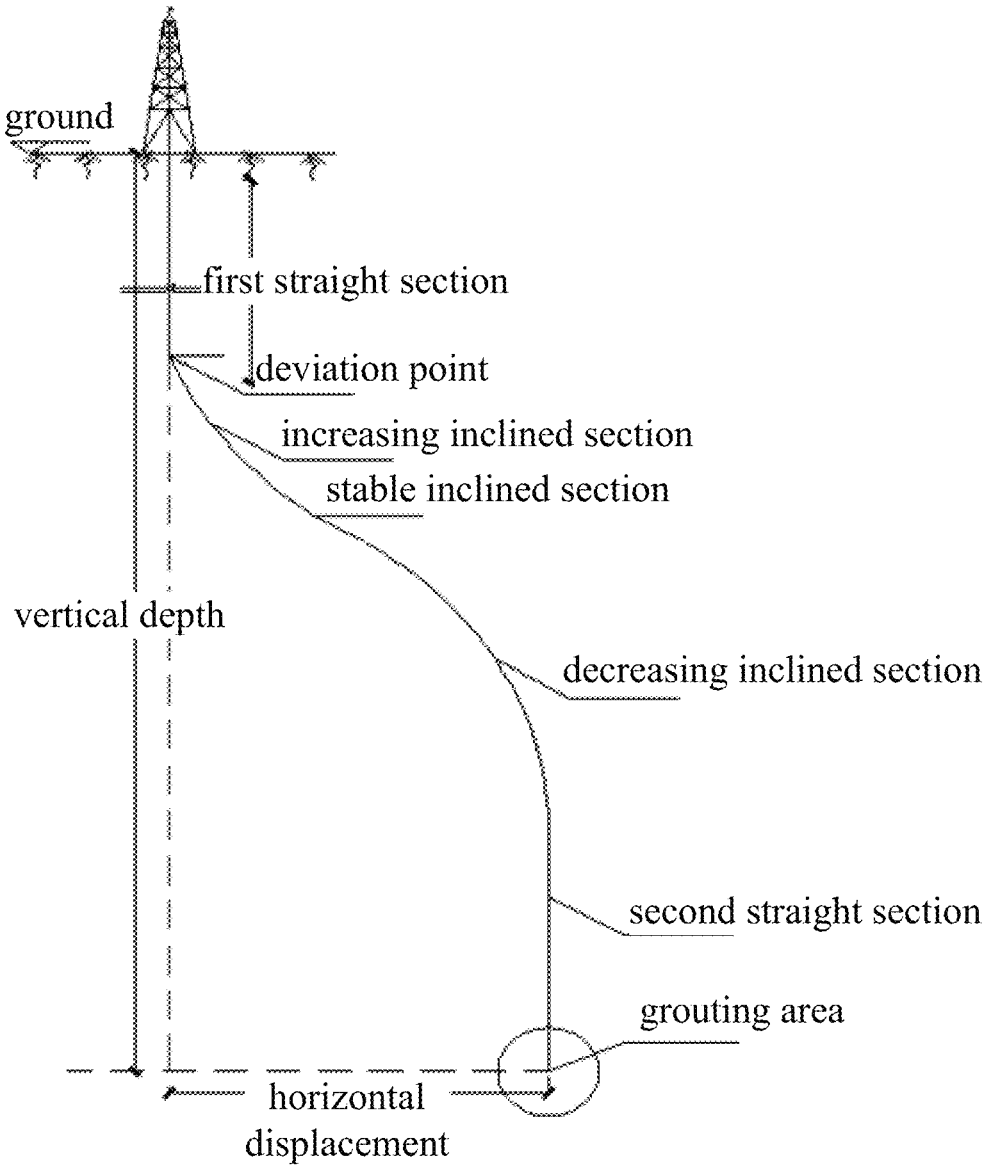
FIG. 2 is a schematic diagram illustrating the drilling trajectory with a relatively large offset according to examples of the present disclosure.

In examples of the present disclosure, the drilling trajectory determined may have a relatively large offset. Specifically, an offset refers to a horizontal displacement between the drilling start point and the drilling end point on a horizontal projection plane. In cases when the drilling trajectory has a large offset, even if the overlying strata of the coal seam are broken, the entire drilling trajectory may not be affected. Therefore, water inflow in the coal mine will be greatly reduced. FIG. 2 is a schematic diagram illustrating the drilling trajectory with a relatively large offset according to examples of the present disclosure. As shown in FIG. 2, the drilling trajectory with a relatively large offset may include various types of drilling sections. For example, these drilling sections may include: a first straight well section, a deviation point, an increasing inclined section, a stable inclined section, a decreasing inclined section and a second straight section. In examples of the present disclosure, an inclination angle of the straight well section may be less than or equal to 0.01°/m. An inclination angle of the increasing inclined section may be controlled in a rage of 9-15°/m. An inclination angle of the stable inclined section may be a fixed value, which can be determined based on actual drilling environments. A sum of lengths of the increasing inclined section and the stable inclined section should be greater than or equal to 25 m. A foundation of a smooth drilling progress may be laid by calculating required parameters for the drilling trajectory in advance. It should be noted that in order to make the drilling trajectory determined more accurate, the parameters disclosed can be determined in combination with factors such as drilling tools, drilling aperture, and rotation speed. An accurate drilling trajectory lays a foundation of a smooth drilling progress. After drilling according to the drilling trajectory, a directional hole with a large offset in the hard rock stratum may be obtained. As shown in FIG. 2, the drilling start point is on the ground, and the drilling end point is in the grouting area underground. Moreover, there is a horizontal displacement between the drilling start point and the drilling end point on a horizontal projection plane.

In step 103, at least one drilling device corresponding to the drilling trajectory is determined based on types of multiple rock layers contained in the hard rock stratum.

In examples of the present disclosure, after determining the drilling trajectory, in order to ensure a smooth drilling progress, it is necessary to determine appropriate drilling devices. One skilled in the art would understand, a hard rock stratum may consist of multiple types of rock layers. Different rock layers may have different hardness. Therefore, different rock layers may require different drilling devices with different drilling abilities. The drilling ability of a drilling device can be reflected by harness of a rock layer that can be drilled by the drilling device. Specifically, the stronger the drilling ability of the drilling device, the higher harness of the rock layer that can be drilled by the drilling device. On the contrary, the weaker the drilling ability of the drilling device, the lower harness of the rock layer that can be drilled by the drilling device. By selecting appropriate drilling devices for the multiple rock layers contained in the hard rock stratum according to the harness of the multiple rock layer, not only construction difficulties in the hard rock stratum can be reduced, but also a construction efficiency in the hard rock stratum can be improved. Since the drilling trajectory can reveal the multiple rock layers that the drilling may pass through, appropriate drilling devices can be selected based on the rock hardness of the multiple rock layers that the drilling trajectory passes through. Therefore, the construction efficiency in the hard rock stratum can be ensured.

In step 104, the multiple rock layers contained in the hard rock stratum are drilled sequentially according to the drilling trajectory using the at least one drilling device.

In examples of the present disclosure, each rock layer along the drilling trajectory may correspond to an appropriate drilling device. For each rock layer, the rock layer is drilled by its corresponding drilling device. The multiple rock layers are drilled sequentially along the drilling trajectory, which ensures a smooth drilling progress. It should be noted that before drilling, a construction plan should be preliminarily determined based on construction techniques and relevant information that have been mastered. During the drilling process, construction data should be strictly recorded and a data analysis should be done. While drilling, the construction plan may be adjusted based on analysis results of the construction data and specific situations encountered during the construction process.

In step 105, in response to determining there is a water leakage area in one of the multiple rock layers after drilling, the water leakage area is grouted.

In examples of the present disclosure, when determining the drilling trajectory, besides considering the drilling efficiency, efforts should also be made to avoid the drilling trajectory passing through aquifers in the hard rock stratum. Aquifers can be divided into an area with high water yield property and water conducting fracture zones, and an area with high water yield property but no water conducting fracture zones. Among them, a well with a water inflow greater than 5 L/s has an extremely high water yield property, a well with a water inflow within a range of 1-5 L/s has a high water yield property, a well with a water inflow within a range of 0.1-1 L/s has a medium water yield property, and a well with a water inflow less than 0.1 L/s has a low water yield property. However, in cases where the drilling trajectory inevitably needs to pass through an aquifer, water leakage areas may be generated during the construction process of the mine. If there is a water leakage area, it is necessary to inject grout into the water leakage area to seal the water leakage area. In this way, a permeability coefficient of the aquifer may be reduced greatly, and lateral water inflows of the aquifer may be reduced greatly. Therefore, a coordinated prevention and control of roof water damage and rock burst disasters can be achieved, and a safety production of a mine can be ensured.

It should be noted that during the grouting process, fracturing grouting is a main method used, with a slurry being diluted at first and then heavy. That is, the specific gravity of the slurry is small at first and then becomes large. The grouting completion standard should not be lower than a final pressure. That is, the pressure should not be released after 15-20 minutes of water pressure. Moreover, by adopting segmented backflow injection technology of grouting holes, the diffusion of slurry would be more uniform through backflow injections. In this way, wastes of slurry in the grouting holes and excessive solidifications of pores can be reduced. For example, in areas of rock fragmentation, a small amount of grouting can be used to stabilize the borehole wall, and segmented drilling can be carried out at intervals of 0 m-15 m-30 m-40 m-60 m. In the segmented drilling process, stop grouting plugs should be installed for grouting. Therefore, the drill bit needs not to be lifted after drilling one segment.

It can be seen that in the grouting and water blocking method for a hard rock stratum provided by this disclosure, based on the hydrogeological information and the coal scam information of the hard rock stratum obtained, the drilling trajectory of the hard rock stratum can be determined. The step of determining the drilling trajectory lays a foundation for a smooth progress of subsequent drilling. Further, based on the types of multiple rock layers contained in the hard rock stratum, at least one drilling device corresponding to the drilling trajectory can be determined to ensure efficient drilling. Then, using the at least one drilling device, the multiple rock layers in the hard rock stratum may be drilled sequentially according to the drilling trajectory, which ensures the smooth progress of the drilling. At last, whether there is a water leakage area in the rock layers are determined after drilling. If there is a water leakage area, the water leakage area may be grouted to achieve a purpose of grouting and scaling the water leakage area, which may greatly reduce a permeability coefficient of the aquifer. In this way, a lateral water inflow of the aquifer may be greatly reduced, and water damages and rock burst disasters can be prevented and controlled. As a result, a safety production of coal mine can be achieved.

In some examples of the present disclosure, the step of determining a drilling trajectory of the hard rock stratum based on the hydrogeological information and the coal scam information may include: determining a drilling range of the hard rock stratum based on the hydrogeological information and the coal scam information; selecting a drilling start point that meets a preset condition within the drilling range; and determining the drilling trajectory corresponding to the drilling start point.

In some examples of the present disclosure, in order to avoid a rupture of an overlying rock layer of each layer, it is necessary to drill holes with a relatively far distance from the overlying rock layers of the coal seam. Therefore, it is necessary to determine the drilling range of the hard rock stratum. After determining the drilling range, it is necessary to select a drilling start point that meet the preset conditions within the drilling range. The preset conditions may include conditions that avoid affecting surrounding environments and conditions that ensure the construction safety. For example, a condition can be avoiding constructions in an area with underground pipelines or buildings in mining areas that may cause damage or impact on the surrounding environments and facilities. Another condition can be avoiding constructions in an area prone to geological hazards such as faults, folds, karst, and weak layers. The drilling start point should be selected in an area with good geological structure and good geological conditions. A reasonable drilling start point may ensure the safety of constructions, which may make the mine less prone to collapse thus ensure the safety of coal mining.

In some examples of the present disclosure, the drilling range of the hard rock stratum may be determined according to a formula: $L \geq L_1 + \Sigma_{i=1} \Delta \mathrm{Sec}\theta_i l_i + \Sigma_{j=1} \Delta \mathrm{Sec}\theta_0 l_i + L_2$, where, L represents a drilling radius, $L_1$ represents a length of a first straight section corresponding to the drilling start point, $L_2$ represents a length of a second straight section corresponding to a drilling end point, $\theta_i$ represents a drilling inclination angle of an increasing inclined section between the drilling start point and the drilling end point, $\theta_0$ represents a drilling inclination angle of a stable inclined section between the drilling start point and the drilling end point, $\Delta l_i$ represents a spacing between every two measurement points during a drilling process of the increasing inclined section, and $\Delta l_j$ represents a spacing between every two measurement points during a drilling process of the stable inclined section.

In some examples of the present disclosure, to ensure that there is a significant horizontal displacement between the drilling start point and the drilling end point on the horizontal projection plane, i.e. to ensure that the drilling trajectory has a relatively large offset, it is necessary to determine a drilling radius. When the drilling radius mentioned above is greater than or equal to an estimated offset, it can be ensured that the drilling trajectory has a relatively large offset. The parameters required for calculating the estimated offset can be determined through historical experience and specific calculations. Usually, a condition of $\Sigma_{i=1}\Delta Sec\theta_i l_i+\Sigma_{j=1}\Delta Sec\theta_0 l_i \geq 25$ should be met. Through the formula, an accurate drilling radius can be obtained, which makes the drilling trajectory determined more accurate.

In some examples of the present disclosure, the step of determining at least one drilling device corresponding to the drilling trajectory based on types of multiple rock layers contained in the hard rock stratum may include: for each rock layer of the multiple rock layers, determining a hardness of the rock layer; and determining a drilling device for the rock layer based on the hardness of the rock layer; where, rock layers with different hardness may correspond to different drilling devices.

In some examples of the present disclosure, rock layers with different hardness require different drilling devices, which enables a smooth and efficient drilling of the hard rock stratum. For example, the hardness of rock layers in the hard rock stratum can be divided into three categories based on the hydrogeological information. A first type is the loose rock and soil layer. For this type of rock layer, a configuration of drilling device may include: a power head, a drill rod, a straight screw, TCX-50 magnetic flux gate inclinometer and a hard alloy drill bit. A second type is the shallow hard rock layer. For this type of rock layer, a configuration of drilling device may include: a power head, a drill rod, a directional joint, a straight screw, TCX-50 magnetic flux gate inclinometer, and a diamond electroplated toothed roller drill bit. A third type is the deep hard rock layer. For this type of rock layer, a configuration of drilling device may include: a power head, a drill rod, an MWD drilling directional instrument, and a diamond hot pressed toothed roller drill bit.

In addition, it is necessary to select corresponding inclinometers based on actual construction. For example, inclinometers can be magnetic flux gate inclinometers, gyroscopic inclinometers, or infinite drilling directional instruments. Among them, the magnetic flux gate inclinometers have high accuracy and strong applicability. However, in metal mines, especially in iron mines, the iron in rock layers may have a significant impact on the accuracy of the magnetic flux gate inclinometers. In addition, the gyroscopic inclinometers can be divided into mechanical gyroscopic inclinometers and fiber optic gyroscopic inclinometers. The fiber optic gyroscopes have poor seismic resistance and high cost. The mechanical gyroscopes wear fast and have poor seismic resistance and high daily maintenance costs.

In some examples of the present disclosure, whether there is a water leakage area in one of the multiple rock layers may be determined by determining whether a volume of drilling fluid recycled by the drilling device is less than a preset volume of the drilling fluid; and in response to determining the volume of drilling fluid recycled by the drilling device is less than the preset volume of the drilling fluid, a water leakage area occurs.

In some examples of the present disclosure, the drilling fluid is a flushing medium circulated within a borehole during a drilling process. The drilling fluid can be divided into clean water, mud, clay free flushing fluid, emulsion, foam and compressed air according to composition. The clear water is the earliest drilling fluid used, which does not need treatment and is convenient to use. The clear water is suitable for intact rock formations and areas with sufficient water sources. Mud is a widely used drilling fluid, mainly suitable for unstable rock formations which are loose, fractured, prone to collapse and block falling, or swelling and peeling when encountering water. Due to the fact that the drilling fluid can be recycled in the drilling device, once a capacity of the drilling fluid recycled is less than a preset drilling fluid capacity, it indicates that there is a water leakage area in the rock layer after drilling. In this way, a goal of accurately determining the water leakage area can be achieved.

In some examples of the present disclosure, the multiple rock layers may include: a layered coal seam, a Carboniferous coal seam, or a Jurassic coal seams.

In some examples of the present disclosure, the method may further include: if a rock layer corresponding to the water leakage area is a layered coal seam, the water leakage area is determined by the following formula:

$$H_{f1} = \frac{100\sum M_1}{1.6\sum M_1 + 3.6} \pm 5.6;$$

where, $H_{f1}$ represents the water leakage area corresponding to the layered coal seam, and $M_1$ represents a mining thickness of the layered coal seam; if a rock layer corresponding to the water leakage area is a Carboniferous coal seam, the water leakage area is determined by the following formula:

$$H_{f2} = \frac{100\sum M_2}{0.26\sum M_2 + 6.88} \pm 5.6,$$

where, $H_{f2}$ represents the water leakage area corresponding to the Carboniferous coal seam, and $M_2$ represents a mining thickness of the Carboniferous coal seam; if a rock layer corresponding to the water leakage area is a Jurassic coal seam, the water leakage area is determined by the following formula: $H_{f3}=20M_3\pm10$, where, $H_{f3}$ represents the water leakage area corresponding to the Jurassic coal seam, and $M_3$ represents a mining thickness of the Jurassic coal scam.

In some examples of the present disclosure, the layered coal seams, the Carboniferous coal seams, or the Jurassic coal seams are usually located at the straight sections of the hard rock stratum. In order to extract coals in these aforementioned coal seams, the drilling trajectory needs to pass through these coal seams. Since the height of a coal seam may correspond to a water leakage area, it is necessary to calculate the height of each of the above-mentioned coal seams. Further, different coal seams have different heights, which can be determined according to specific calculation formulas. By using specific parameters, the water leakage area of the rock layer can be determined accurately, so that grouting and water blocking can be carried out on the rock layer according to the water leakage area. In this way, the safety of coal mining can be ensured.

In some examples of the present disclosure, the method may further include: before grouting into the water leakage area, in response to determining that a leakage amount in the water leakage area is less than a first preset leakage amount and greater than or equal to a second preset leakage amount, adjusting a ratio of liquid to a first solid in a slurry to be injected in the drilling device based on the leakage amount; and in response to determining that the leakage amount in the water leakage area is greater than or equal to the first preset leakage amount, a second solid is added to the slurry to be injected in the drilling device, and adjusting a ratio of the liquid, the first solid, and the second solid in the slurry to be injected in the drilling device based on the leakage amount.

In some examples of the present disclosure, when the leakage amount in the water leakage area is relatively small, that is, the leakage amount is less than the first preset leakage amount and greater than or equal to the second preset leakage amount, the ratio of the liquid to the first solid of the slurry to be injected in the drilling device can be adjusted. The liquid can be water, and the first solid can be cement. In the above ratio adjustment process, the ratio may increase with the increase of the leakage amount. For example, with the increase of the leakage amount, the ratio of the liquid to the first solid can change from a ratio of 1:1 to 1:2, 1:2.5, 1:3, 1:4.5. When the leakage amount in the water leakage area is relatively high, i.e. the leakage amount is greater than or equal to the first preset leakage amount, a second solid can be added to the slurry to be injected, and the ratio of the liquid, first solid, and second solid can be adjusted. The liquid can be water, the first solid can be cement, and the second solid can be aggregates, such as fine aggregate and clay. In the above ratio adjustment process, the ratio may increase with the increase of the leakage amount. For example, assuming that the ratio of water to cement to fine aggregate to clay is a:b:c:d, where, the value of a can vary from 0.4 to 1.5; the value of b can vary from 0.6 to 1.3; the value of c can vary from 0.6 to 1.3; the value of d can vary from 0.6 to 1.3.

In some examples of the present disclosure, the hydrogeological information may include rock hardness corresponding to each rock layer. Here, the rock harness may refer to a pre-estimated hardness corresponding to the rock layer. The method may further include: before drilling the multiple rock layers contained in the hard rock stratum sequentially according to the drilling trajectory using the at least one drilling device, for each rock layer, detecting a detected hardness of the rock layer; in response to determining that a difference between the detected hardness of the rock layer and the rock harness of the rock layer is greater than a preset difference, adjusting the drilling device corresponding to the rock layer.

In some examples of the present disclosure, the drilling device corresponding to a rock layer in the hard rock stratum is not fixed. During the drilling process, it is necessary to conduct a real-time hardness detecting on the rock layer through which the drilling passes. Once it is determined that the detected hardness is different from the pre-estimated hardness of the rock layer, the drilling device corresponding to the rock layer may be adjusted timely. For example, during the drilling process, if the detected hardness of the rock layer is greater than the pre-estimated hardness of the rock layer, the drilling device can be adjusted to use the TSJ-2000 drilling rig, combined with the F130 mud pump, MWD (Measure While Drilling) directional instrument, and TCX-50 magnetic flux gate inclinometer, to complete the drilling of the rock layer. Such dynamic replacement of drilling devices ensures that the drilling device selected matches the hardness of the rock layer. In this way, the drilling efficient can be further improved.

In some examples of the present disclosure, the method may further include: after grouting into the water leakage area, monitor the water leakage area after grouting; and replacing the slurry in response to determining the slurry fails to block water.

In some examples of the present disclosure, there may still be situations where the grout used for grouting cannot effectively block the water, which can also be referred to as a slurry running phenomenon. During the construction process, it is necessary to monitor the slurry running phenomenon. Once a water leakage occurs, the grout used for grouting can be replaced timely. For example, early strength cement can be used to replace ordinary cement. Moreover, additives such as sodium silicate and clay may be added to the slurry. To prevent the occurrence of the slurry running phenomenon, pressurized measures can be taken while specialized paste curing agents can be used. By monitoring the water leakage area after grouting not only reduces the amount of grouting but also reduces the impact of grouting on production and safety.

In some examples of the present disclosure, the method may further include: after grouting into the water leakage area, determining a weight of rock debris recycled by the drilling device; and in response to determining that the weight is less than or equal to a preset weight, increasing a viscosity of the drilling fluid.

In some examples of the present disclosure, after grouting the water leakage area, it is also necessary to determine the weight of the rock debris recycled by the drilling device. If the weight of the rock debris recycled is less than or equal to the preset weight, the drilling device needs to increase the viscosity of the drilling fluid. For example, the viscosity of the increased pump volume can be between 15-30, so that the rock debris can be smoothly adsorbed back to the drilling device through the drilling fluid. In order to further ensure a smooth recovery of rock debris, it is also possible to increase the viscosity of the drilling fluid while increasing the pumping capacity of the mud pump.

It should be noted that, the drilling device can be used to extend drill rods into the drilled rock layer. By pulling the drill rods upwards along the mine hole wall, an accumulation of rock debris unrecycled can be prevent. Therefore, a formation of a rock debris bed can be avoided. After the above pulling operation is completed, a water level of pre-stored water in the drilling device may be measured at predetermined time intervals. For example, the predetermined time interval can be set as 30 minutes. After the measurement is completed, pump water for 15-20 minutes to fully circulate the rock debris in the borehole. In this way, the mud on the wall of the borehole may be cleaned, which may facilitate the grouting progress.

In some other examples of the present disclosure, a mine can not only be used to mine coal resources, but also be used to mine other resources in the hard rock stratum. In an example, an average water inflow in a main and auxiliary well areas of a certain metal mine is about 18000 t/d, the groundwater is classified as brine by chemical classification, and the chloride ion content is extremely high, which cannot meet the government's zero emission requirements for environmental protection. To meet the requirements of energy conservation and emission reduction, as well as green and sustainable production, it is necessary to inject grout and seal the water leakage areas of this metal mine. In a case that the metal mine is built on the mountain, and the site does not have uniform hole layout conditions, according to the hole layout principle, 4 drilling devices may be arranged in suitable positions, using 4 main boreholes and directional drilling technology to branch 17 grouting boreholes to inject grout into the water containing cracks of the rock layer. In this way, a water stop curtain can be formed.

It should be noted that the method according to examples of the present disclosure may be performed by a single device, such as a computer or server. Moreover, the method according to examples of the present disclosure can also be applied to a distributed scenario, where the method can be implemented through cooperation of multiple devices. In the case of such a distributed scenario, one device of the plurality of devices may only perform one or more steps of the method, and the plurality of devices may interact with each other to perform the described method.

It is noted that some examples of the present disclosure have been described above.

Other examples are within the scope of the following claims. In some cases, the acts or steps recited in the claims may be performed in a different order than in the examples described above and can still achieve desirable results. Additionally, the processes depicted in the accompanying drawings do not necessarily require the particular order shown, or sequential order, to achieve desirable results. In some examples, multi-tasking and parallel processing are also possible or may be advantageous.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. For example, other memory architectures, such as dynamic RAM (DRAM), may use the examples discussed.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A grouting and water blocking method for a hard rock stratum, comprising:

obtaining hydrogeological information and coal seam information of a hard rock stratum;

determining a drilling trajectory of the hard rock stratum based on the hydrogeological information and the coal seam information; wherein, determining the drilling trajectory of the hard rock stratum comprises: determining a drilling range of the hard rock stratum based on the hydrogeological information and the coal seam information; selecting a drilling start point that meets a preset condition within the drilling range; and determining the drilling trajectory corresponding to the drilling start point; wherein, the drilling range of the hard rock stratum is determined according to a formula:

$$L \geq L_1 + \sum_{i=1} \Delta Sec\theta_i l_i + \sum_{j=1} \Delta Sec\theta_0 l_j + L_2$$

wherein, L represents a drilling radius; $L_1$ represents a length of a first straight section corresponding to the drilling start point; $L_2$ represents a length of a second straight section corresponding to a drilling end point; $\theta_i$ represents a drilling inclination angle of an increasing inclined section between the drilling start point and the drilling end point; $\theta_0$ represents a drilling inclination angle of a stable inclined section between the drilling start point and the drilling end point; $\Delta l_i$ represents a spacing between every two measurement points during a drilling process of the increasing inclined section; and $\Delta l_j$ represents a spacing between every two measurement points during a drilling process of the stable inclined section;

determining at least one drilling device corresponding to the drilling trajectory based on types of multiple rock layers contained in the hard rock stratum;

drilling the multiple rock layers contained in the hard rock stratum sequentially according to the drilling trajectory using the at least one drilling device; and determining whether there is a water leakage area in one of the multiple rock layers after drilling, in response to determining there is a water leakage area, grouting into the water leakage area.

2. The method according to claim 1, wherein, determining at least one drilling device corresponding to the drilling trajectory based on types of multiple rock layers contained in the hard rock stratum comprises:

for each rock lay of the multiple rock layers, determining a hardness of the rock layer; and determining a drilling device for the rock layer based on the hardness of the rock layer; wherein, rock layers with different hardness correspond to different drilling devices.

3. The method according to claim 1, wherein, determining whether there is a water leakage area in one of the multiple rock layers after drilling comprises:

in response to determining a volume of drilling fluid recycled by the drilling device is less than a preset volume of the drilling fluid, determining a water leakage area occurs.

4. The method according to claim 1, wherein, the multiple rock layers comprise: a layered coal seam, a Carboniferous coal seam, or a Jurassic coal seam;

the method further comprises:

in response to determining a rock layer corresponding to the water leakage area is a layered coal seam, determining the water leakage area by a following formula:

$$H_{f1} = \frac{100\sum M_1}{1.6\sum M_1 + 3.6} \pm 5.6;$$

wherein, $H_{f1}$ represents the water leakage area corresponding to the layered coal seam, and $M_1$ represents a mining thickness of the layered coal seam;

in response to determining a rock layer corresponding to the water leakage area is a Carboniferous coal seam, determining the water leakage area by a following formula:

$$H_{f2} = \frac{100\sum M_2}{0.26\sum M_2 + 6.88} \pm 5.6;$$

wherein $H_{f2}$ represents the water leakage area corresponding to the Carboniferous coal seam, and $M_2$ represents a mining thickness of the Carboniferous coal seam;

in response to determining a rock layer corresponding to the water leakage area is a Jurassic coal seam, determining the water leakage area by a following formula: $H_{f3}=20M_3\pm10$; wherein, $H_{f3}$ represents the water leakage area corresponding to the Jurassic coal seam, and $M_3$ represents a mining thickness of the Jurassic coal seam.

5. The method according to claim 1, wherein, before grouting into the water leakage area, the method further comprises:

in response to determining that a leakage amount in the water leakage area is less than a first preset leakage amount and greater than or equal to a second preset leakage amount, adjusting a ratio of liquid to a first solid in a slurry to be injected in the drilling device based on the leakage amount; and in response to determining that the leakage amount in the water leakage area is greater than or equal to the first preset leakage amount, adding a second solid to the slurry to be injected in the drilling device, and adjusting a ratio of the liquid, the first solid, and the second solid in the slurry to be injected in the drilling device based on the leakage amount.

6. The method according to claim 1, wherein, the hydrogeological information comprises a rock hardness corresponding to each rock layer;

before drilling the multiple rock layers contained in the hard rock stratum sequentially according to the drilling trajectory using the at least one drilling device, the method further comprises:

for each rock layer, detecting a detected hardness of the rock layer; and in response to determining that a difference between the detected hardness of the rock layer and the rock harness corresponding to the rock layer is greater than a preset difference, adjusting the drilling device corresponding to the rock layer.

7. The method according to claim 1, wherein, after grouting into the water leakage area, the method further comprises:

monitoring the water leakage area after grouting; and in response to determining a slurry fails to block water, replacing the slurry.

8. The method according to claim 1, wherein, after grouting into the water leakage area, the method further comprises:

determining a weight of rock debris recycled by the drilling device; and in response to determining that the weight is less than or equal to a preset weight, increasing a viscosity of the drilling fluid.

* * * * *